US006923842B2

(12) United States Patent
Furuya

(10) Patent No.: US 6,923,842 B2
(45) Date of Patent: Aug. 2, 2005

(54) METHOD AND APPARATUS FOR PRODUCING FINE PARTICLES, AND FINE PARTICLES

(75) Inventor: Masahiro Furuya, Tokyo (JP)

(73) Assignee: Central Research Institute of Electric Power Industry, Tokyo (JP)

( * ) Notice: Subject to any disclaimer, the term of this patent is extended or adjusted under 35 U.S.C. 154(b) by 189 days.

(21) Appl. No.: 10/258,328

(22) PCT Filed: Apr. 23, 2001

(86) PCT No.: PCT/JP01/03464

§ 371 (c)(1),
(2), (4) Date: Jan. 29, 2003

(87) PCT Pub. No.: WO01/81033

PCT Pub. Date: Nov. 1, 2001

(65) Prior Publication Data

US 2004/0224040 A1 Nov. 11, 2004

(30) Foreign Application Priority Data

Apr. 21, 2000 (JP) ..... 2000-121673
Sep. 22, 2000 (JP) ..... 2000-289478

(51) Int. Cl.[7] ..... B22F 9/06

(52) U.S. Cl. ..... 75/331; 75/338; 75/340; 264/5; 264/12; 266/137; 266/202; 425/7

(58) Field of Search ..... 75/255, 331, 378, 75/390; 264/5, 12

(56) References Cited

U.S. PATENT DOCUMENTS 3,658,507 A * 4/1972 Gohin et al. ..... 75/369
3,723,076 A * 3/1973 Benesovsky ..... 75/244
3,771,996 A * 11/1973 Short ..... 75/371
3,856,899 A * 12/1974 Schott ..... 264/8
3,905,841 A * 9/1975 Simonetti ..... 148/105

(Continued)

FOREIGN PATENT DOCUMENTS

| | | |
|---|---|---|
| JP | 57-29504 | 2/1982 |
| JP | 57-029505 | 2/1982 |
| JP | 59-089701 | 5/1984 |
| JP | 59-190304 | 10/1984 |
| JP | 62-214107 | 9/1987 |
| JP | 63-028802 | 2/1988 |
| JP | 03-024201 | 2/1991 |
| JP | 3-271306 | 12/1991 |
| JP | 06-172819 | 6/1994 |

*Primary Examiner*—George Wyszomierski
(74) *Attorney, Agent, or Firm*—Notaro & Michalos PC

(57) ABSTRACT

A method and apparatus are invented for producing fine particles, which can readily realize the formation of fine particles of sub-$\mu$m order to 100 micron order as well as fine particles of several micrometer which cannot be realized by a conventional method and apparatus available for producing fine particles, and a large quantity of fine particles having the desired particle diameter can be obtained with a high yield. A molten material (1), which is a molten raw material to be fragmented into fine particles, is supplied into a liquid coolant (4), boiling due to spontaneous-bubble nucleation is generated, and the molten material (1) is cooled and solidified while forming fine particles thereof by utilizing a pressure wave generated by this boiling. This production method is realized by apparatus comprising: material supplying means (3); a cooling section (2) which brings in the coolant (4) whose quantity is small and sufficient for cooling and solidifying the supplied molten material (1), and cools and solidifies the molten material (1) while forming fine particles thereof by utilizing a pressure wave generated by boiling due to spontaneous-bubble nucleation; and recovery means (5) for recovering fine particles from the coolant (4).

19 Claims, 7 Drawing Sheets

U.S. PATENT DOCUMENTS 4,092,459 A * 5/1978 Deffeyes et al. ..... 428/403
4,147,533 A * 4/1979 Flinn et al. ..... 420/18
4,376,740 A * 3/1983 Uda et al. ..... 75/336
4,456,473 A * 6/1984 Jost ..... 75/371
4,489,773 A * 12/1984 Miller ..... 164/463
4,576,634 A * 3/1986 Badesha et al. ..... 75/370
4,595,412 A * 6/1986 Brunelli et al. ..... 75/363
4,619,845 A * 10/1986 Ayers et al. ..... 427/422
4,645,532 A * 2/1987 Mackiw et al. ..... 75/370
4,673,430 A * 6/1987 Pfeil ..... 420/441
4,758,266 A * 7/1988 Chou ..... 75/370
4,778,515 A * 10/1988 Kemp et al. ..... 75/342
5,853,451 A * 12/1998 Ishikawa ..... 75/367

* cited by examiner

METHOD AND APPARATUS FOR PRODUCING FINE PARTICLES, AND FINE PARTICLES

TECHNICAL FIELD

The present invention relates to a method and an apparatus for producing fine particles. More particularly, the present invention relates to improvement of a method and an apparatus for producing fine particles in which a material to be fragmented into fine particles is molten and then cooled with a coolant to perform fragmentation and solidification thereof. Further, the present invention relates to fine particles produced by the above-described production method.

BACKGROUND ART

As a conventional method for producing metal powder, there are a water atomizing method, which obtains metal powder by injecting a high pressure water jet to a flow of a molten material, a gas atomizing method which uses $N_2$ gas or Ar gas in place of the water jet in the water atomizing method, and a centrifugation method which injects a molten metal jet into cooling water in a rotary drum rotating at high speed. Fine particles are also produced by a breakdown method such as mechanical fragmentation using a mill or the like and further by a buildup method such as a precipitation method or a sol-gel method.

However, in the water atomizing method and the gas atomizing method, structure of a nozzle should be complicated and a burden is imposed on the nozzle, resulting in making the nozzle worse in terms of durability since the molten metal can be fragmented into powder form by a flow of high pressure cooling water or cooling gas. On the other hand, in the centrifugation method, the structure of the apparatus is complicated because of the high-speed rotation of the rotary drum. Furthermore, all of the methods crush the molten metal using collision energy, and there occurs dispersion in the fragmentation and the fine particles cannot be formed with good yield.

The breakdown method using mechanical fragmentation or the like can produce only large particles up to, for example, approximately 100 $\mu$m. The buildup method such as a precipitation method can produce fine particles up to approximately 1 $\mu$m, and particles which are larger than that cannot be obtained. Therefore, it is difficult to obtain fine particles having the size ranging from several micrometer order to 10 $\mu$m order, particularly about 3 $\mu$m order in the conventional method as well as the apparatus for producing the fine particles.

Also, in the breakdown method, the percentage of the molten metal not being turned into fine particles and left as a lump is large. Therefore, a good yield of fine particles cannot be obtained. In addition, the particle size distribution is scattered and fine particles with desired particle diameter can not be obtained in large amount.

It is an objective of the present invention to provide a method and an apparatus which can produce fine particles of a metal or the like, the method being a simple method and the apparatus having a simple structure. Furthermore, the present invention enables easy production of fine particles having a size of submicrometer order to 100 $\mu$m order which cannot be realized in the previous method and apparatus. Moreover, it is another objective of the present invention to develop a method and apparatus for producing fine particles having desired particle diameter with good yield and an excellent extraction rate.

DISCLOSURE OF INVENTION

To achieve this aim, a method for producing fine particles devised in the present invention supplies a molten material, which has a raw material to be fragmented into fine particles being molten therein, into a liquid coolant, forms a vapor film which covers the molten material in the coolant, collapses the vapor film, directly brings the molten material into contact with the coolant, causes boiling by spontaneous-bubble nucleation, forms fine particles of the molten material while tearing the molten material by utilizing the pressure wave induced by the boiling, and cools and solidifies the molten material. That is, by continuously producing safe and small-scale vapor explosion by controlling the quantities of the fed molten material and the coolant to be small, the present invention realizes fragmentation of the molten material. Preferably, in the fine-particle production method, the molten material molten at a temperature which causes an interface temperature with the coolant when directly brought into contact with the coolant to become not less than a spontaneous-bubble nucleation temperature and which is not more than a film boiling lower limit temperature is supplied into the coolant, a stable vapor film which covers the molten material is formed, and the vapor film is caused to collapse by condensation. More preferably, the molten material is supplied dripwise into the coolant. It is to be noted that the method and the apparatus of the present invention can aim at any material such as molten ash, blast furnace slag or other ceramic materials which can be molten and solidified by cooling.

A vapor film is formed around the molten material supplied into the coolant when the coolant vaporizes due to the heat transferred from the molten material. This vapor film stabilizes when the heat budget between vaporization which progresses by receiving heat from the molten material and cooling by the coolant is balanced. However, when the temperature of the molten metal is lowered, the heat budget collapses and condensation occurs (spontaneous collapse). Alternatively, collapse occurs due to external factors such as the pressure wave, a difference in flow rate between the molten material and the coolant, or contact with another material (forced collapse). In case of condensation, collapse of the vapor film occurs simultaneously over the entire surface. Therefore, contact with the coolant is carried out simultaneously on the entire surface of the molten material, and boiling due to spontaneous-bubble nucleation occurs around the particles of the molten material.

In the case of boiling caused via spontaneous-bubble nucleation, the boiling starts from the inside of the coolant. In order to realize nucleate boiling in water coolant, the surface tension of the water/coolant must be overcome, and the vapor embryo must be generated. An initial temperature condition at that moment is the spontaneous-bubble nucleation temperature and, for example, it is 313° C. under 1 barometer pressure in the case of water. Therefore, if an interface temperature at which the vapor film collapses and the molten material and the coolant are directly brought into contact with each other is not less than the spontaneous-bubble nucleation temperature, the vapor embryo is generated in the coolant. When the vapor embryo is once generated, vaporization is enabled at 100° C. Therefore, vapor continuously gathers there, which results in explosive boiling. In addition, since vapor generation due to spontaneous-bubble nucleation is rapid and involves production of the pressure wave, the particles of the molten material are fragmented so as to be pulled apart by the pressure wave, thereby fragmenting into fine particles. In particular, when collapse of the vapor film occurs due to condensation, the high pressure wave is uniformly incident on the entire volume of the molten material, and hence fine particles can be efficiently fragmented without leaving a large lump of the material. At the same time, since the molten material which has been fragmented into fine particles has an increased specific surface area, cooling becomes faster. Additionally, cooling and solidification are performed through the transition of latent heat. Since the fragmentation into fine particles of the molten material further increases the specific surface area and increases the cooling rate, there is a positive feedback process whereby vaporization from the coolant is increased and a further pressure wave is produced, and the fragmentation into fine particles is facilitated. At the same time, cooling is carried out rapidly. The cooling rate at this moment is far greater than $10^7$ K/s which can rapidly cool and solidify the molten material.

Furthermore, in the method developed for producing fine particles, the molten material is supplied into the coolant by a dripping action. In this case, a large part of the cubic volume of the dripped molten material is involved in spontaneous-bubble nucleation, and efficient fragmentation into fine particles of the material droplet is facilitated and the particle recovery rate can be further improved. In order to realize high efficiency (formation of fine particles and the realization of the desired cooling rate), a small molten material droplet diameter is preferable. For example, the molten material having the size of several hundreds of micrometer or preferably, atomized material, is brought into contact with the coolant. In this case, the specific surface area is increased, fragmentation into fine particles advances, and the cooling rate is exponentially increased. However, It has been experimentally observed by the present inventor that the droplet size does not greatly affect the fragmentation into fine particles when the particle diameter to be obtained is not less than several tens of micrometer and the cooling rate is not more than $10^6$ K/s (even this value cannot be achieved by the previous cooling methods).

Furthermore, in the method of producing fine particles of the present invention, salt is added in the coolant. In this case, salt is dissolved and exists around the vapor film which covers the molten material, and molecules of water which exist therein are relatively reduced. Therefore, condensation normally occurs irrespective of the fact that vaporization from the coolant side is hardly generated due to ionic interference, and hence it can be considered that condensation is produced as a whole. Thus, even if the molten material is a material for which spontaneous collapse of the vapor film hardly occurs, e.g., aluminium, with this method collapse of the vapor film is facilitated, and boiling caused through spontaneous-bubble nucleation can be accelerated. Furthermore, in case of ceramics whose fusion point is high and whose initial temperature is high, it takes time for the vapor film condensation to start and spontaneous collapse of the vapor film hardly occurs. In this case, however, salt in the coolant facilitates collapse of the vapor film, thereby accelerating boiling caused through spontaneous-bubble nucleation.

Moreover, in the method for producing fine particles according to the present invention, it is preferable to supply the molten material and the coolant in the same direction and with a small difference in the flow rate, and mix them. In addition, it is preferable to realize coolant flow such that the coolant flows mostly in the vertical direction and supply the molten material in the fall area of the flow of the coolant by free drop or jet injection. In this case, the molten material is supplied into a flow of the coolant without greatly changing the direction thereof, and the molten material is not subjected to a large shear stress from the flow of the coolant. Therefore, vapor film collapse due to external factors can be prevented and spontaneous collapse due to condensation can be achieved. Also, boiling caused by spontaneous-bubble nucleation can be almost simultaneously realized. Here, in regard to violent boiling, i.e., boiling caused by spontaneous-bubble nucleation, when the hot molten material and the cold coolant are brought into mutual contact and the interface temperature becomes not less than the spontaneous-bubble nucleation temperature, these become the initiation conditions and the vapor embryo is generated. Also, when the difference in the flow rate between the molten material and the coolant is sufficiently low, vapor embryo grows and causes violent boiling, i.e., boiling due to spontaneous-bubble nucleation. When the flow rate of the coolant relative to the molten material (relative rate) is too high, boiling due to spontaneous-bubble nucleation does not occur, or even if such boiling occurs to a small extent, cooling occurs and boiling ceases. Thus, it is preferable to match the rate of the molten material with the flow rate of the coolant. For example, the difference in the flow rate between the coolant and the molten material should be not than 1 m/s, or preferably, this difference should be close to zero. In this case, the shear stress acting on the molten material from the flow of the coolant can be further suppressed.

Furthermore, in the method for producing fine particles devised in the present invention an ultrasonic wave is irradiated before the molten material comes into contact with the coolant. In this case, since the molten material can be supplied into the coolant as fine particles to some extent, the specific surface area of the molten material droplet can be increased and fragmentation into fine particles via vapor explosion can be further facilitated as a whole. Also, the cooling rate can be further improved.

Moreover, the molten material may be possibly oxidized when it is brought into contact with air before being supplied into the coolant when the molten material is an easily oxidizable material such as a metal. Oxidation of the molten metal changes the property of the metal, and the oxide layer is not uniformly formed. Therefore, formation of fine particles/cooling does not simultaneously occur. Thus, the vapor explosion cannot be satisfactorily utilized, and the efficiency of fragmentation into fine particles is decreased. Consequently, the method for producing fine particles devised in the present invention supplies the molten metal into the coolant while preventing oxidation of the molten metal.

Further, an method for producing fine particles according to the present invention may cause a vapor film which covers a molten material to collapse by ultrasonic irradiation. That is, it is possible to early collapse the vapor film which covers each droplet of the molten material in the coolant, directly bring the droplet of the molten material into contact with the coolant in a high-temperature state, and cause efficient boiling due to spontaneous-bubble nucleation.

Moreover, fine particles according to the Present invention are produced by using the above-described method.

Furthermore, an apparatus for producing fine particles devised in the present invention comprises: material supplying means for supplying a molten material, which has a raw material to be fragmented into fine particles being molten therein, while controlling the supply quantity thereof; a cooling section which introduces a small quantity of coolant which is sufficient for cooling and solidifying the molten material, mixes the coolant with a small quantity of the molten material fed from the material supplying means to form a vapor film which covers the molten material, collapses the vapor film, directly brings the molten material into contact with the coolant, causes boiling due to spontaneous-bubble nucleation, and turns the molten material into fine particles and solidifies them while tearing the molten material by utilizing the pressure wave generated by the boiling due to spontaneous-bubble nucleation; and recovery means for recovering fine particles from the coolant.

In case of this apparatus, by releasing the molten material from a nozzle, fine particles of the molten material are formed by a pressure wave due to boiling through spontaneous-bubble nucleation in the coolant. Furthermore, the fine particles of the solidified fine particles can be collected by only separating them from the coolant. Therefore, an atomizing nozzle having a complicated structure, a drive mechanism for rotating at a high speed or a power portion attached to these parts is not necessary. The equipment cost can be suppressed, the excellent durability can be realized, and the possibility of failure is low.

Here, when boiling caused through spontaneous-bubble nucleation is determined to have a scale which allows the pressure wave to form fine particles of the molten material dropped into the coolant by setting quantities of the molten material to be fed and the coolant to be small, the pressure wave generated by boiling due to spontaneous-bubble nucleation can be prevented from becoming larger than the required amount, thereby avoiding generation of the large-scale vapor explosion. Furthermore, by setting the quantity of the coolant remaining in the cooling section to a quantity which does not allow the large-scale vapor explosion even if the molten material is supplied all at once due to loss of control in the material supplying means, the large-scale vapor explosion which leads to a disaster does not occur even if a large quantity of the molten material flows out when the material supplying means breaks down.

Moreover, in the apparatus for producing fine particles devised in the present invention, the material supplying means introduces the molten material into the coolant dropwise. Therefore, almost the entire cubic volume of the dropped molten material is involved with the spontaneous-bubble nucleation, thereby facilitating formation of fine particles of the molten material droplets.

In addition, in the apparatus for producing fine particles devised in the present invention, salt is added to the coolant used therein. In this case, even in case of a material which hardly generates spontaneous collapse of vapor film such as aluminum which is considered not to cause vapor explosion, collapse of the vapor film is facilitated, and boiling due to spontaneous-bubble nucleation can be generated. Also, in case of such materials as ceramics whose fusion point is high, boiling due to spontaneous-bubble nucleation can be generated. Therefore, such materials which are difficult to form into fine particles, e.g., aluminum can be turned into fine particles.

Additionally, the apparatus for producing fine particles devised in the present invention causes the coolant to flow in the vertical direction in free space, and a cooling section is constituted so as to supply the molten material in the fall area of the flow of the coolant by free fall. In this case, since spontaneous collapse of vapor film can be invoked without subjecting the molten material to the shear stress due to the flow of the coolant, fine particles can be efficiently formed, and the cooling section itself is no longer necessary in the structure. Therefore, the cost can be reduced, and the incidence of accidents or failures can be decreased.

Furthermore, the apparatus for producing fine particles devised in the present invention includes ultrasonic wave irradiating means for irradiating ultrasonic waves to the molten material between the material supplying means and the coolant. Therefore, the molten material droplets which have been levigated to some extent by the ultrasonic wave irradiating means as a means of fragmentation can be supplied into the coolant. Accordingly, the formation of fine particles of the molten material in the coolant can be further facilitated, and the cooling rate can be further improved. Also, since the fragmentation technique using ultrasonic waves has already been established, primary fragmentation of the molten material can be safely and easily realized.

Furthermore, the apparatus for producing fine particles devised in the present invention includes oxidation inhibiting means which prevents oxidation of the molten metal fed from the material supplying means to the cooling section. Therefore, the molten metal can be brought into contact with the coolant without causing oxidation, and boiling due to spontaneous-bubble nucleation is ensured to occur. Moreover, droplets of the molten material can be prevented from scattering around the cooling section.

Additionally, the apparatus for producing fine particles according to the present invention causes the vapor film which covers the molten material to collapse by ultrasonic irradiation. Therefore, it is possible to early collapse the vapor film which covers each droplet of the molten material in the coolant, directly bring the droplet of the molten material into contact with the coolant in a high-temperature state, and cause efficient boiling due to spontaneous-bubble nucleation.

BEST MODE FOR CARRYING OUT OF THE INVENTION

The structure of the present invention will now be described in detail hereinafter based on the illustrated best mode.

Figure 1:
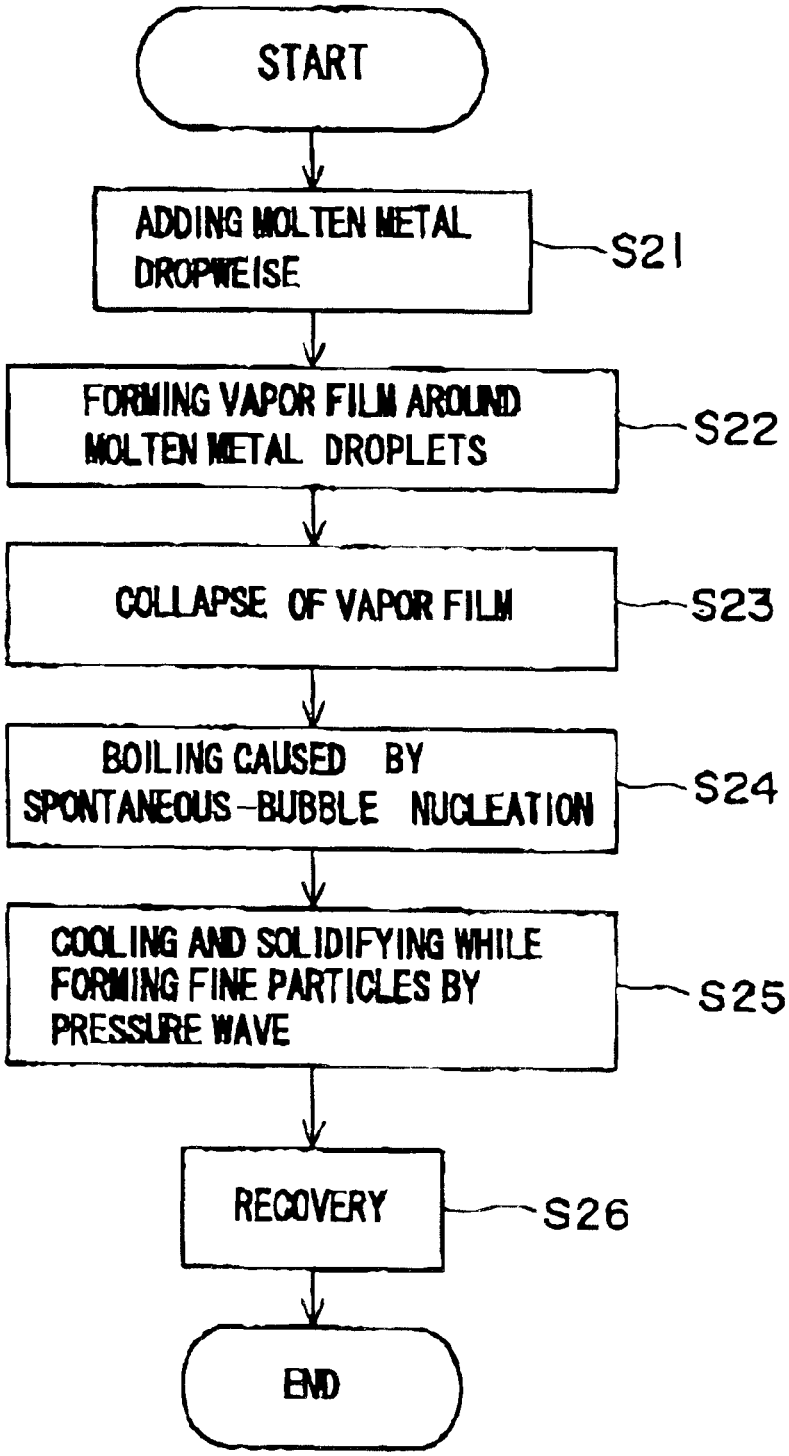
FIG. 1 is a flowchart showing an application of the method for producing fine particles devised in the present invention to a production of fine particles of metal.
Figure 2:
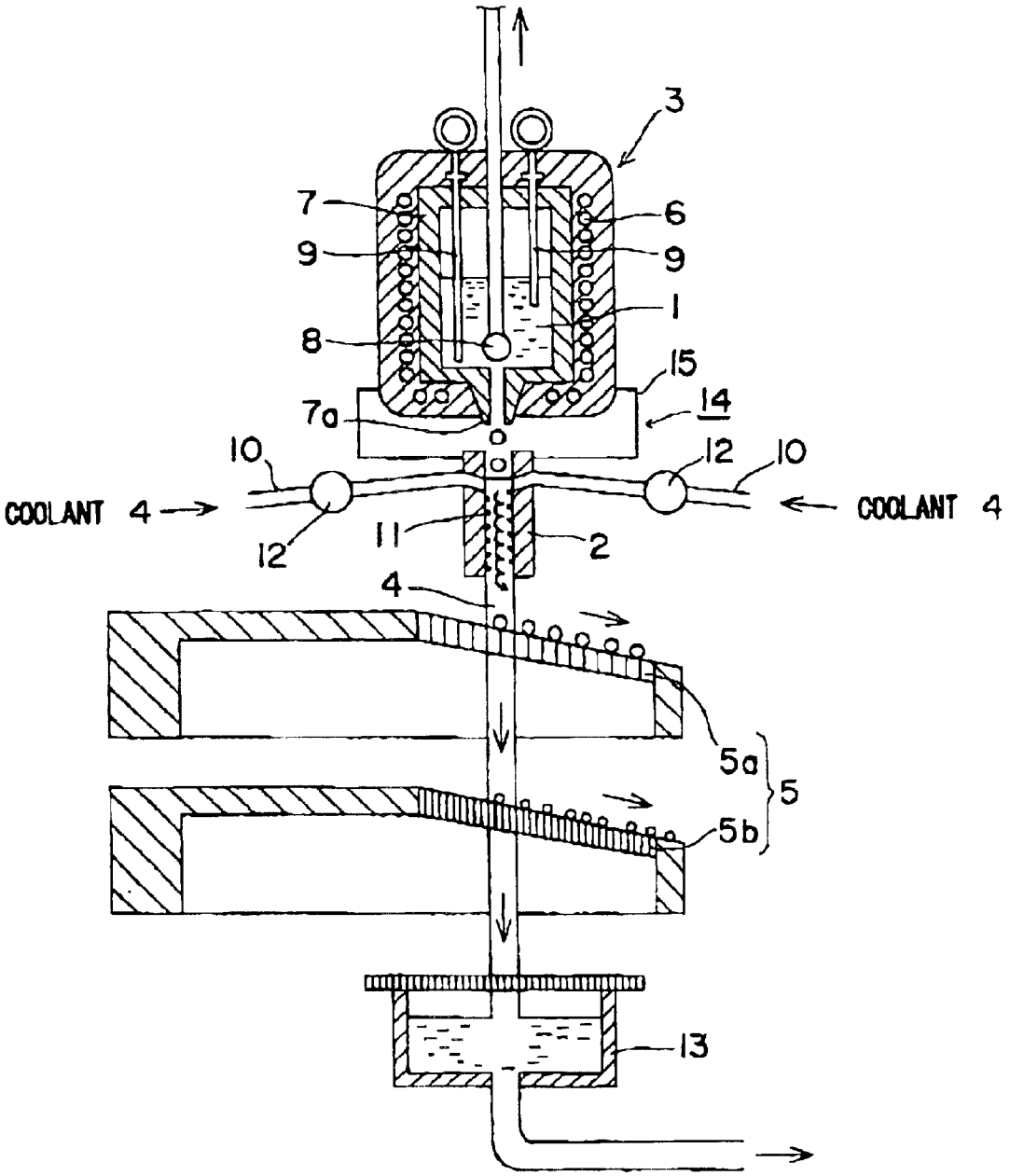
FIG. 2 is a conceptual view showing an example of an apparatus to which the present invention is applied for producing fine particles of metal.
Figure 3:
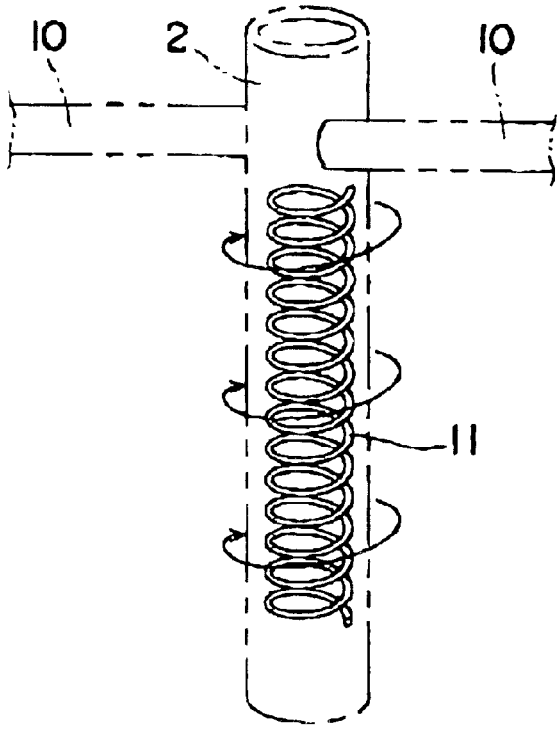
FIG. 3 is a conceptual view showing the state that a swirl flow guide wire is arranged in a mixing nozzle.
Figure 4:
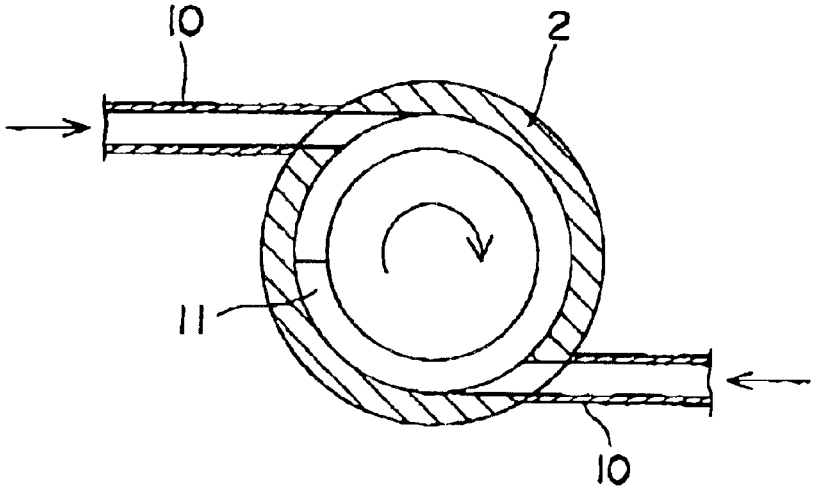
FIG. 4 is a cross-sectional view showing the connection relationship between the mixing nozzle and swirl water nozzle.

FIG. 1 shows an example of an application of the method for producing fine particles devised in the present invention to a production of metal fine particles, and FIGS. 2 to 4 show an example of an apparatus to which the present invention is applied for producing metal fine particles. This production apparatus includes: material supplying means 3 which supplies a molten metal 1 as the molten material having a raw material to be fragmented into fine particles being molten therein while controlling the supply quantity thereof; a cooling section 2 which introduces a coolant 4 which cools and solidifies the molten metal 1, mixes the coolant 4 with the molten metal 1 fed from the material supplying means 3, forms a vapor film which covers the molten metal 1, collapses the vapor film, directly brings the molten metal 1 into contact with the coolant 4, cools the mixture and realizes fragmentation thereof by utilizing boiling caused through spontaneous-bubble nucleation; and recovery means 5 for recovering solidified metal fine particles from the coolant 4.

The material supplying means 3 constitutes, e.g., a crucible 7 provided with a keep-warm heater 6. This crucible 7 includes a stopper 8 which opens/closes a hot water outlet 7*a* provided on the bottom, and thermocouples 9 which measures a temperature of the molten metal 1 in the crucible 7. The stopper 8 controls the quantity of the molten metal 1 which drops from the hot water outlet 7*a* or completely stops the molten metal 1 by moving up/down by an actuator (not shown). As for the supply of the molten metal 1, it is preferable to set the quantity of the molten metal 1 as small as possible and its specific surface area large in order to increase the efficiency of fragmentation and prevent the large-scale vapor explosion which may lead to an accident. Thus, in this scenario, droplets of the molten metal are supplied in a moniliform manner one by one by free fall, each of which weighs, e.g., several g. However, the present invention is not restricted to this droplet size, and it is preferable to set this droplet smaller than the droplet diameter of the liquid molten metal in order to obtain high fragmentation efficiency. For example, the molten metal droplets having the size of several hundreds of micrometer, or more preferably, those of atomized molten metal are brought into contact with the coolant.

The cooling section 2 is constituted by a nozzle (which will be referred to as a mixing nozzle hereinafter) 2 having the structure which mixes the molten metal 1 with the constantly cold coolant 4 and simultaneously passes the mixture. The mixing nozzle 2 is set directly under the hot water outlet 7*a* of the crucible 7 so as to receive the molten metal 1 dropping from the crucible 7. It is preferable to set the distance from the hot water outlet 7*a* of the crucible 7 to the liquid surface of the coolant 4 in the mixing nozzle 2 as short as possible. For example, it is preferable to set this distance to approximately 30 mm, not more. As a result, the collision force between the molten metal droplets of the molten material and the coolant can be reduced, the molten metal droplets can be smoothly fed into the coolant, and then dropped together with the coolant without causing collapse of the vapor film covering the droplets. Thus, a stable vapor film can be formed, and it can be collapsed by spontaneous collapse due to condensation all at once, thereby causing boiling due to spontaneous-bubble nucleation.

Here, with respect to the mixing nozzle 2 as the cooling section, it is required to ensure that the contact time of the molten metal and the coolant is sufficient for fragmenting the molten metal 1 by causing boiling through spontaneous-bubble nucleation (rapid vaporization phenomenon). Thus, the mixing nozzle 2 in this scenario has, e.g., a cylindrical shape, and a swirl water nozzle 10 which injects water as the coolant 4 is connected to the circumferential wall portion thereof. Two swirl water nozzles 10 are adopted and, as shown in FIG. 4, they are connected to the upper part of the mixing nozzle 2 at an interval of 180° in such a manner that they align in the tangential direction with respect to the inner peripheral surface of the mixing nozzle 2. Here, in order to provoke vapor explosion, no flow of the coolant is preferable. Thus, in order to increase the retention time in the mixing nozzle 2 without causing a difference in flow rate between the molten metal 1 and the coolant 4, a coil-like swirl flow guide wire 11 is provided on the inner peripheral surface of the mixing nozzle 2 so as to facilitate formation of a swirl flow by providing this guide wire from an injection opening of a swirl water nozzle 10 to an outlet at the lower end of the mixing nozzle in such a manner that the swirl flow continues to the lower part of the mixing nozzle 2 along the guide wire 11. Therefore, the water/coolant 4 injected from the two swirl water nozzles 10 forms a flow (swirl jet flow) which falls while swirl along the inner peripheral surface of the mixing nozzle 2 together with the droplets of the molten metal 1. As a result, the contact time of the molten metal and the coolant can be prolonged, and the time until the vapor film collapses due to cooling of the molten metal and the subsequent boiling owing to spontaneous-bubble nucleation (rapid vaporization phenomenon) can be assured.

A control valve 12 is provided to the piping portion in the middle of the swirl water nozzle 10, and the flow rate and the flow quantity of the swirl flow in the mixing nozzle 2 can be thus adjusted. The coolant 4 has a flow rate which does not cause the vapor film generated by mixing with the molten metal 1 to collapse, and it is adjusted so that the swirl flow can be formed so as to enable the coolant 4 to stay in the mixing nozzle 2 for a given time. Incidentally, if the flow rate of the coolant 4 is too fast, a vortex or a depressed area on the water surface of the coolant 4 is generated at the center of the mixing nozzle 2, and this degrades the fragmentation effect of the metal droplet 1. Therefore, it is desirable to set the flow rate of the coolant 4 to that which does not generate a depressed area on the water surface or a vortex, for example, not more than 1 m/s, or more preferably as low a rate as possible. Furthermore, although not shown, it is preferable to provide a cooler which cools the coolant to the supply system which circulates and supplies the coolant according to the requirements.

As described above, by forming the swirl flow of the coolant 4 in the mixing nozzle 2, the coolant 4 can be held in the mixing nozzle 2 for a given time. Therefore, the amount of the coolant 4 to be used can be reduced, and large-scale vapor explosion does not occur.

The inside diameter of the mixing nozzle 2 is sufficiently larger than the diameter of the droplet of the molten metal 1 while small enough so that the swirl flow which slowly flows can be formed. For example, it is the inside diameter of approximately 2 to 8 mm or more, and approximately 25 mm or less. The quantity of the coolant 4 swirling in the mixing nozzle 2 is sufficient to fully fill the circumference of the droplet of the molten metal 1 dropped into the mixing nozzle 2. For example, the coolant 4 having a cubic volume which is at least fivefold or more than that of the metal droplet is supplied. At the same time, the amount of the coolant 4 is desired to be small such that the large-scale vapor explosion does not occur even if the crucible 7 is damaged. In the experiment conducted by the present inventor, it is preferable to set the amount of the coolant held in the mixing nozzle 2 at a time to approximately 100 ml or lower.

The molten metal 1 is heated by the keep-warm heater 6 to a temperature such that the interface temperature between the molten metal and the coolant becomes a spontaneous-bubble nucleation temperature or higher, or more preferably a temperature which is sufficiently higher than the spontaneous-bubble nucleation temperature when the molten metal 1 is directly brought into contact with the coolant 4. Furthermore, the temperature of the molten metal 1 is set to, e.g., a temperature at which the vapor film collapses when the molten metal 1 is directly brought into contact with the coolant 4, namely, a film boiling lower limit temperature or below. This film boiling lower limit temperature is defined by temperatures of the molten metal and the coolant when there is no external force applied.

As the coolant 4, it is possible to use any liquid which can cause boiling through spontaneous-bubble nucleation when it is brought into contact with the molten material such as a molten metal which should be turned into fine particles. For example, water or liquid nitrogen, an organic solvent such as methanol or ethanol or any other liquid is preferable. In general, water which is superior in terms of economical efficiency and safety is used. Selection of the coolant 4 is determined in accordance with the material of the molten metal 1. For example, when the melting point of the molten metal 1 is low as with gallium, liquid nitrogen is adopted as the coolant 4. Incidentally, when the molten metal 1 is a material which hardly causes spontaneous collapse of the vapor film such as aluminum, iron or zinc, it is preferable to add salt such as sodium chloride, potassium chloride or calcium chloride to the coolant 4. For example, when zinc is used as the molten metal 1, it is possible to cause spontaneous collapse of the vapor film by using a sodium chloride solution as the coolant 4, thereby provoking vapor explosion. Moreover, when, e.g., $Al_{89}$—$Si_{11}$ based alloy is used as the molten metal 1, spontaneous collapse of the vapor film can be caused by using, e.g., 25 wt % of calcium chloride aqueous solution so that it can be saturated as the coolant 4, thereby invoking vapor explosion of the Al—Si based alloy. In addition, when a material having a high fusion point is used as the molten metal 1, it is preferable to add salt to the coolant 4. As salt to be added in this case, it is possible to use, e.g., calcium chloride, sodium chloride, potassium sulphate, sodium sulphate or calcium nitrate. Of course, it is needless to say that it is desirable to select and use salt which does not react with the molten material. Additionally, as the coolant 4 containing salt, it is preferable to use seawater.

As for the addition of salt to the coolant 4, since salt dissolves and exists around the vapor film which covers the molten metal, molecules of water existing therein are relatively reduced. Therefore, ions interfere and evaporation hardly occurs from the coolant side, but condensation is usually generated. Thus, it can be considered that condensation takes place substantially. Therefore, vapor film collapse can be facilitated.

The recovery means is, e.g., a filter. In this scenario, two filters 5*a* and 5*b* are used to collect metal fine particles having a predetermined particle size. A filter whose mesh is coarser than the target particle size is used as the first filter 5*a*, and a filter whose mesh is finer than the target particle size is used as the second filter 5*b*. Fine metal particles which have passed through the first filter 5*a* and been captured by the second filter 5*b* are collected as products. Furthermore, the amorphous metal collected by the first filter 5*a* is returned to crucible 7, again melted and subjected to processing, forming fine particles.

In this production apparatus, boiling caused through the small-scale spontaneous-bubble nucleation which does not lead to an accident is provoked, fine particles of the molten metal 1 dropped into the coolant 4 are formed by utilizing the pressure wave generated through this boiling. In this scenario, the amount of the coolant led into the mixing nozzle 2 is set as small as possible, the supply amount of the molten material 1 is controlled to be small with the specific surface area thereof being set as large as possible, and boiling due to spontaneous-bubble nucleation is suppressed to a predetermined level by adjusting the quantities of the molten metal 1 and the coolant 4 to come into contact with each other. For example, the large-scale vapor explosion is assuredly prevented from occurring by dropping the molten metal 1 by an amount of several grams and setting the amount of the coolant 4 swirling in the mixing nozzle 2 to approximately 100 ml.

Furthermore, this production apparatus includes oxidation inhibiting means 14 which inhibits oxidation of the molten metal 1 supplied from at least the material supplying means 3 to the mixing nozzle 2. Moreover, in some cases, oxidation inhibiting means which covers the entire production apparatus including the crucible 7 with the inert atmosphere is provided so that the molten metal is not oxidized when held in the crucible 7. This oxidation inhibiting means 14 utilizes, e.g., inert gas, and a casing 15, which blocks off at least the space between the hot water outlet 7*a* of the crucible 7 and the mixing nozzle 2 from the outside, is provided so that the inert gas is filled therein. It is provided in such a manner that the droplets of the molten metal fall in the inert atmosphere. As the inert gas, for example, argon or the like is used.

Fine particles of metal can be manufactured as follows by using the apparatus having the above-described structure.

At first, a predetermined amount of the coolant 4 is supplied into the mixing nozzle 2 from the two swirl water nozzles 10, and a swirl flow which spirally falls is formed. Moreover, the molten metal 1 in the crucible 7 is heated and kept warm at a temperature such that the interface temperature of the molten metal and the coolant when the molten metal directly comes into contact with the coolant 4 becomes sufficiently higher than the spontaneous-bubble nucleation temperature.

In this state, the stopper 8 of the material supplying means 3 is moved up to cause moniliform free fall of the molten metal 1 in the crucible 7 drop by drop (step S21). The molten metal 1 is dispersed in the coolant 4 by the impetus of collision when it collides with the coolant 4 in the mixing nozzle 2, and then enters the coarse mixing state in which it is covered with the film of vapor generated by film boiling since the temperature of the molten metal is high (step S22).

The vapor film is generated around the molten metal 1 by evaporation of the coolant/water upon receiving heat from the molten metal 1. This vapor film becomes stable when the heat budget between evaporation which advances upon receiving heat from the molten metal 1 and cooling using the coolant is balanced. However, when the temperature of the molten metal is lowered, the heat budget is off-balance and condensation takes place. That is, collapse of the vapor film occurs (step S23). This condensation occurs almost simultaneously on the entire surface. Therefore, the molten metal comes into contact with the coolant on the entire surface almost simultaneously and their interface temperature becomes equal to or above the spontaneous-bubble nucleation temperature. Thus, boiling caused through spontaneous-bubble nucleation occurs in the coolant 4 which is the liquid with a lower temperature around the particles of the molten metal (step S24). Boiling due to spontaneous-bubble nucleation produces rapid evaporation, and causes sudden expansion of the vapor bubbles, thereby generating the high pressure wave. This pressure wave propagates at a very high speed and uniformly acts on all of the particles of the molten metal. Therefore, the particles are fragmented so as to be pulled apart by the pressure wave, thereby forming fine particles (step S25). At the same time, by the formation of the fine particles, the specific surface area becomes large, which further increases the cooling rate. This increases evaporation from the coolant and evolves into vapor film formation, vapor film collapse and boiling due to spontaneous-bubble nucleation, thereby generating a further pressure wave.

Thus, when the vapor film collapses by any dispersed particle, the pressure wave generated spreads to other particles, which provokes boiling due to spontaneous-bubble nucleation. Furthermore, since the formation of fine particles of the molten metal increases the specific surface area and increases the cooling rate, there occurs a positive feedback phenomenon that evaporation from the coolant is increased to produce the further pressure wave, and formation of fine particles is facilitated. At the same time, rapid cooling is carried out. Therefore, the molten metal is efficiently formed into fine particles without leaving a large lump.

Here, since the molten metal is formed into fine particles by utilizing the pressure wave generated from bubbles of several nm size generated through spontaneous-bubble nucleation, it can be readily manufactured as fine particles ranging in size from submicrometer order to 100 $\mu$m order. Furthermore, it is possible to realize the production of fine particles with the size of several micrometer which cannot be realized by the conventional apparatus for producing fine particles or approximately 3 $\mu$m in particular which cannot be obtained by the conventional method. Moreover, this formation of fine particles does not leave a large lump by forming fine particles of the metal as a whole at the same time, resulting in a good yield. In addition, since the particle size distribution is concentrated, a large quantity of fine particles of desirable size can be obtained. Additionally, in this case, the efficiency of formation of fine particles per unit mass (percentage of formation of fine particles) can be improved. Furthermore, the specific surface area is increased when formation of fine particles proceeds, thereby increasing the cooling rate.

Moreover, devised in the present production apparatus, fine particles of the molten metal are formed solely by dropping the molten metal into the coolant which swirls and falls in the mixing nozzle 2. Therefore, the structure of the apparatus is simple with good durability, and the manufacturing cost of the apparatus can be suppressed.

Incidentally, the metal fine particles which have been fragmented and the coolant 4 fall in the mixing nozzle 2 while swirling, and the coolant 4 is transmitted through the first filter 5*a* and the second filter 5*b* and returned into the tank 13. Then, the metal fine particles are captured by the filter 5*a* or the filter 5*b*.

In addition, in the above-described scenario, although a description has been given taking the cooling section constituted by the mixing nozzle 2 as an example, the present invention is not restricted to this case. For example, the cooling section 2 may constitute a flow of the coolant emitted into a free space. For example, although not shown, nozzles which emit the coolant around the hot water outlet 7*a* of the crucible 7 and arranged in such a manner that they face vertically downwards, thereby causing the molten metal and the coolant to flow downward in the same direction. In this case, since the flow system becomes a parallel flow system, there is almost no difference in the flow rate between the molten metal and the coolant, and the shear stress which causes collapse of the vapor film does not act. Thus, spontaneous collapse of the vapor film uniformly occurs, and the efficiency of formation of fine particles is improved.

Figure 5:
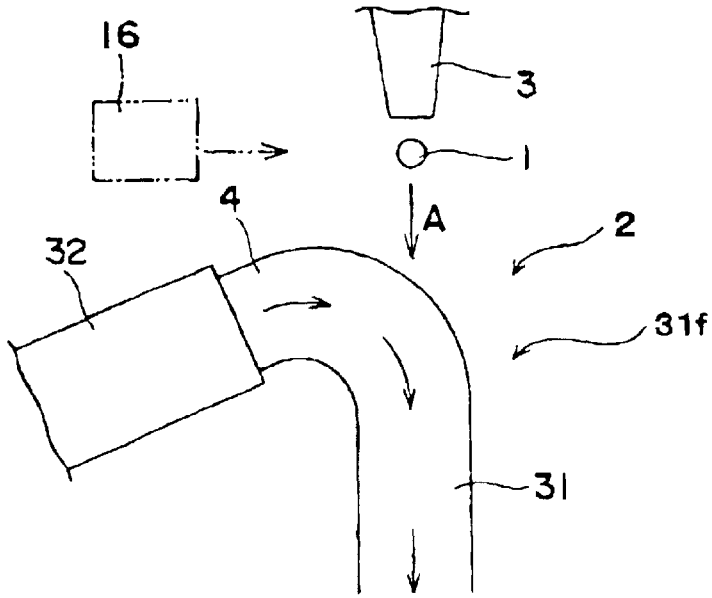
FIG. 5 is a conceptual view showing a first modification of the apparatus for producing fine particles devised in the present invention.

Additionally, as shown in FIG. 5, a nozzle 32 which discharges the coolant 4 upwardly at a slant (or in the horizontal direction although not shown) may be provided, and the molten metal 1 may be dropped and supplied to the part of an area 31*f* in which the flow of the coolant 4 emitted from the nozzle 32 flows in the downward direction by the action of gravitational force. A downward flow area 31*f* can be formed in the vicinity of the nozzle 32 by temporarily discharging the coolant 4 upwards. In this case, since the flow in the area 31*f* which is in the substantially vertical direction of the flow 31 of the coolant 4 is a parallel flow with respect to the supply direction A of the molten metal 1, the dropped molten metal 1 is supplied into the coolant 4 without greatly changing its flowing direction, thereby minimizing the shear stress acting on the molten metal 1 from the flow of the coolant 4. Furthermore, the shear stress acting on the molten metal 1 from the flow 31 of the coolant 4 can be further suppressed by substantially matching the falling rate of the molten metal 1 to be confluent with the flow rate of the coolant 4. That is, although the vapor film is generated between the molten metal 1 and the coolant 4 when the molten metal 1 is introduced into the flow 31 of the coolant 4, the vapor film does not collapse by the shear stress generated by the flow 31 of the coolant 4, but the entire vapor film can collapse by condensation of the vapor film at a blast, thereby causing boiling due to spontaneous-bubble nucleation over a whole surface. In this case, the state in which there is almost no difference in the flow rate between the coolant 4 and the molten metal 1 can be realized by setting the flow rate of the coolant 4 flowing out from the nozzle 32 to, e.g., not more than 50 cm/s, or more preferably approximately 20 cm/s, thereby facilitating the coolant 4 to cause boiling due to spontaneous-bubble nucleation. Although a slower discharge rate of the coolant is preferable, when it is lower than approximately 20 cm/s, an uncluttered flow such as that shown in FIG. 5 cannot be formed since it drips from the nozzle opening. In order to constitute a so-called parallel flow system by which the downward flow area 31*f* which is in basically the same direction as the direction along which the droplets of the molten metal are jetted (falling direction) is formed in the flow 31 of the coolant by discharging the coolant from the side with respect to the supply direction of the molten metal, this can be carried out by arranging the nozzle in the horizontal or slightly downward direction instead of arranging it in the slightly upward direction as with the nozzle 32 shown in FIG. 5. In this case, the coolant can be emitted at a lower rate.

Figure 6:
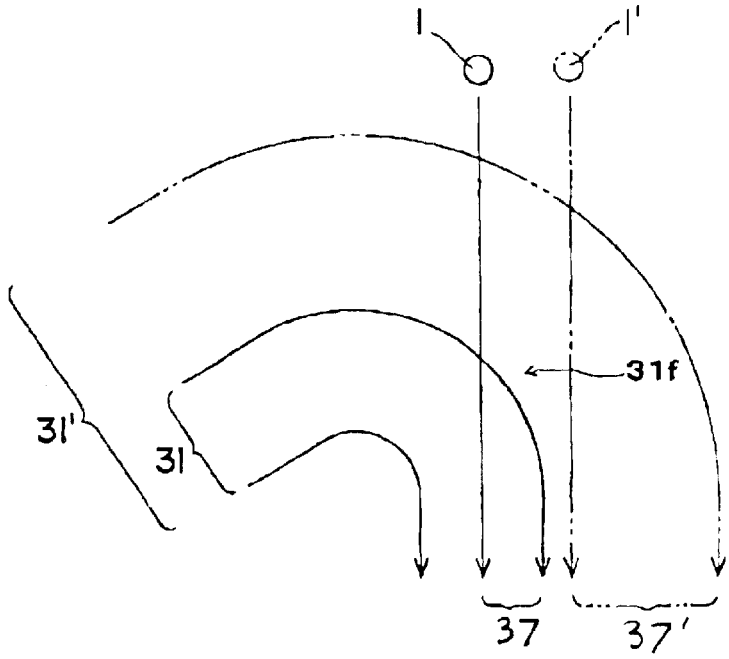
FIG. 6 is a conceptual view showing the state that the molten metal becomes confluent with a flow of the coolant.

Additionally, it is preferable to increase the thickness of the flow 31 in the downward flow area 31*f* in the flow 31 of the coolant 4 to be twofold or fivefold of the thickness of the droplet or jet of the molten metal 1 to be supplied. The thickness of the flow 31 in the downward flow area 31*f* of the coolant 4 is increased to be at least twofold of the thickness of the droplet or jet of the molten metal 1 because a sufficient amount of the coolant 4 which can cause boiling due to spontaneous-bubble nucleation can be ensured around the molten metal 1 in the coolant 4 by setting such a value. Furthermore, the thickness of the flow 31 of the coolant 4 is set to be fivefold or less than of the thickness of the droplet or jet of the molten metal 1 because the shear stress acting on the molten metal 1 is increased when the thickness is set to a larger value. That is, as indicated by the solid line in FIG. 6, when the thickness of the flow 31 of the coolant 4 is small, the quantity of the transverse flow 37 is not large before the molten metal 1 flows into the flow 31. However, as indicated by the chain double-dashed line in FIG. 6, when the flow 31' of the coolant 4 becomes thick, the amount of the transverse flow 37' becomes large until the molten metal 1 flows together with the flow 31', and a larger shear stress acts is received. That is, by setting the thickness of the flow 31 of the coolant 4 to a value which falls within the above-described range, a sufficient quantity of the coolant 4 can be ensured around the molten metal 1, and also the shear stress received from the flow 31 of the coolant 4 can be suppressed. Incidentally, does not necessarily have to be set upwards at a slant, and may be set in the horizontal direction or downwards at a slant, for example.

Figure 7:
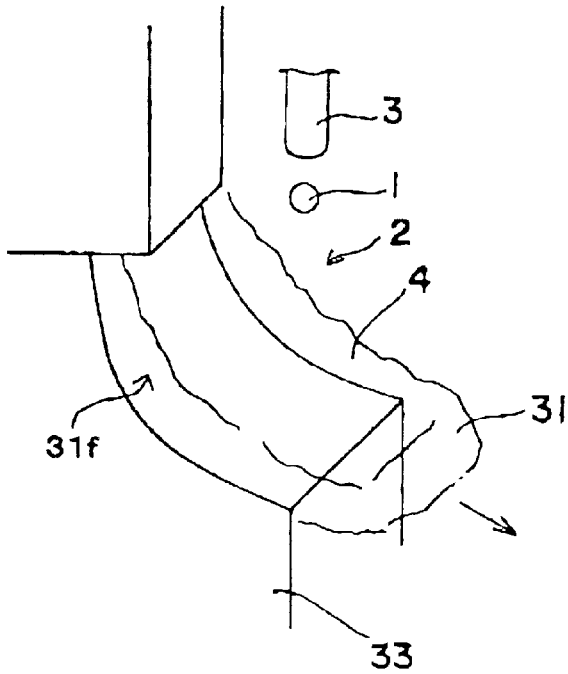
FIG. 7 is a conceptual view showing a second modification of the apparatus for producing fine particles devised in the present invention.

Furthermore, as shown in FIG. 7, the flow 31 of the coolant 4 whose downward direction varies to the horizontal direction by flowing the coolant 4 on a curved guide 33 may be formed, and the molten metal 1 may be supplied to this flow 31 from the material supplying means 3. By doing so, a small amount of the coolant 4 can suffice, and a sufficient quantity of the coolant 4 can be ensured around the molten metal 1.

Figure 8:
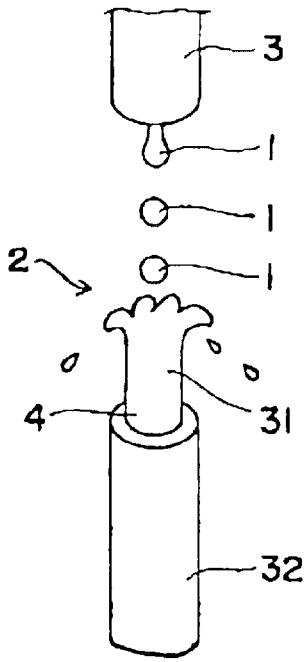
FIG. 8 is a conceptual view showing a third modification of the apparatus for producing fine particles devised in the present invention.

Moreover, as shown in FIG. 8, the nozzle 32 which injects the coolant 4 may be set upwards, and the molten metal 1 may be supplied from directly above the nozzle 32. By adopting such a structure, the cooling section 2 which cools the molten metal 1 becomes simple and compact. Therefore, many nozzles 32 can be aligned and arranged in a small space, and the apparatus suitable for mass production can be realized. That is, metal fine particles can be produced on a large level with smaller equipment investment.

Figure 9:
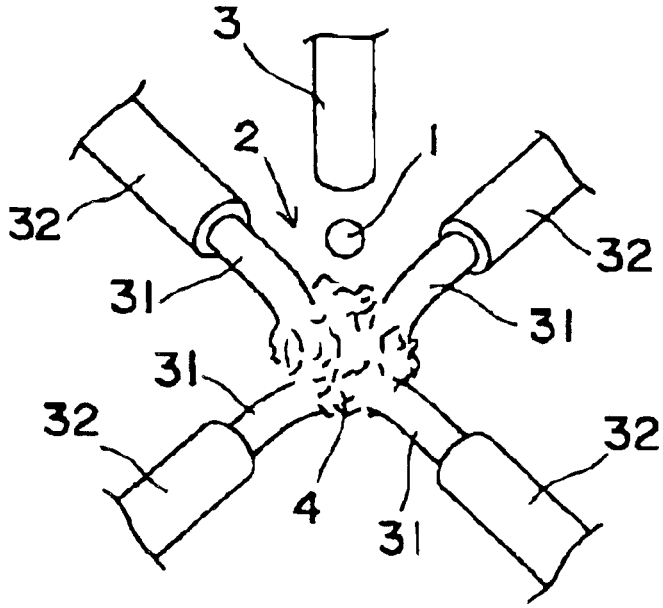
FIG. 9 is a conceptual view showing a fourth modification of the apparatus for producing fine particles devised in the present invention.

In addition, as shown in FIG. 9, multiple nozzles 32 which inject the coolant 4 toward the point of fall of the molten metal 1 may be provided so as to surround this point of fall. In FIG. 9, four nozzles 32 are provided in the circumferential direction at intervals of 90 degrees. By injecting the same amount of the coolants 4 from the four nozzles 32 at the same rate and causing the coolants 4 to collide with each other, the flow 31 of the coolant 4 is canceled out, thereby forming a buildup of the coolant 4 in the cooling section 2. That is, by injecting the coolant 4 from the four nozzles 32 toward the point of fall of the molten metal 1, the buildup of the coolant 4 of a sufficient amount which can cause boiling due to spontaneous-bubble nucleation can be formed around the supplied molten metal 1, thereby improving the fine particle yield. That is, the percentage of the fine particles each having a predetermined particle size or a smaller size can be increased, thus improving the yield of fine particle production. Incidentally, by injecting the coolant 4 from the four nozzles 32 at a flow rate of, e.g., 50 cm/s, the buildup of the coolant 4 which is suitable for causing boiling due to spontaneous-bubble nucleation can be formed.

Figure 10:
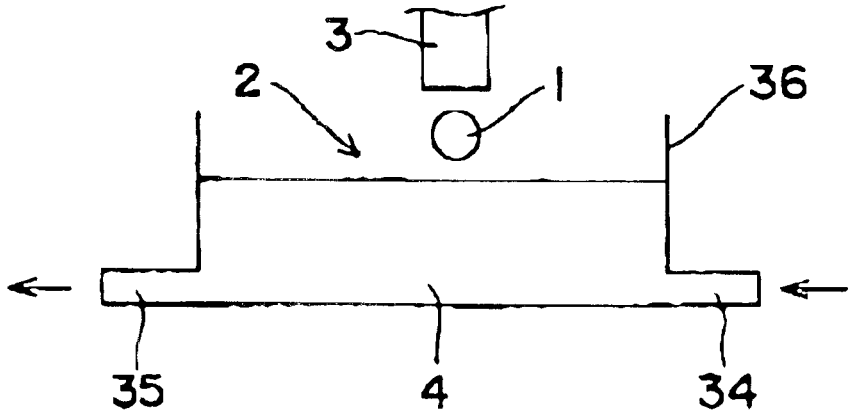
FIG. 10 is a conceptual view showing a fifth modification of the apparatus for producing fine particles devised in the present invention.

Additionally, as shown in FIG. 10, the molten metal 1 can be supplied into a pool 36 in which the coolant 4 flows in from a port 34 and flows out from a port 35. In this case, by forming the circumferential wall of the pool 36 to a given height, all of the manufactured metal fine particles can be collected in the pool 36. Therefore, recovery of the metal fine particles can be facilitated.

Here, the influence of a difference in the mixing system between the coolant and the molten metal on the formation of fine particles will be described with reference to FIG. 11, and the influence of a difference in the molten metal temperature on the formation of fine particles will be explained in connection with FIG. 12.

Figure 11:
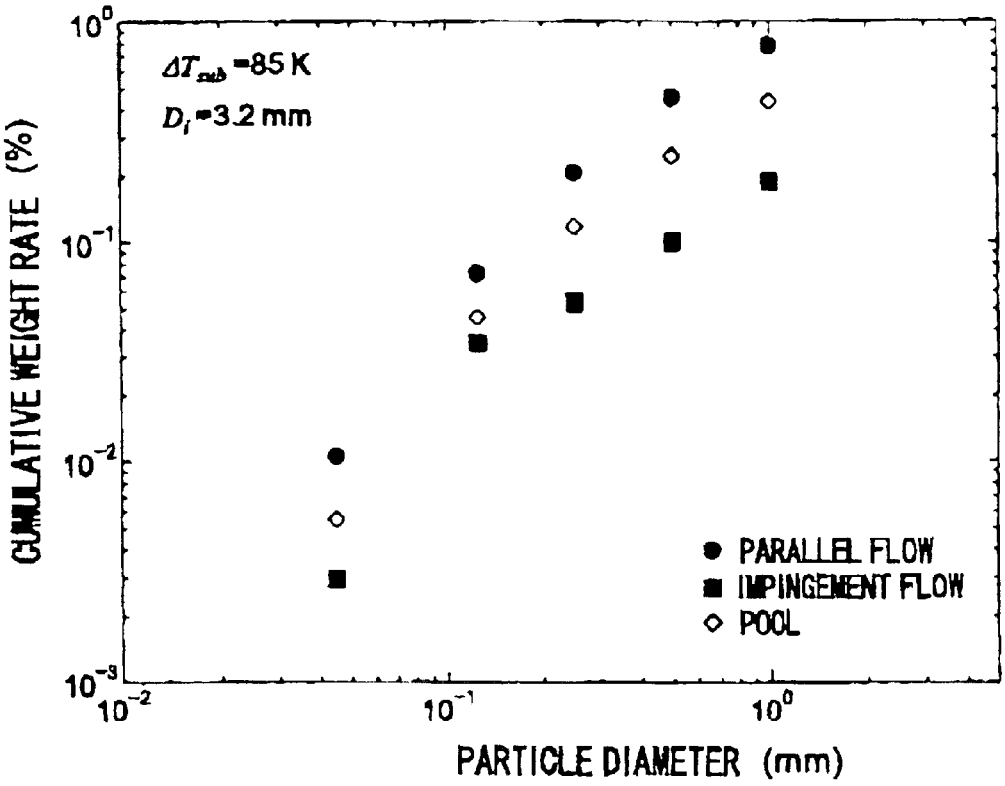
FIG. 11 is a graph showing the relationship between the method for supplying the molten metal into the coolant and particle size distribution of the molten metal levigated by this method.

FIG. 11 shows particle size distribution of the molten metal (tin) relative to three different types of contact modes of the coolant and the molten metal. Water is used as the coolant, and the parallel-flow method for supplying the water is illustrated in FIG. 5. It is a method for supplying the molten metal 1 to the flow 31 of the coolant 4 in a direction basically equal to the supply direction of the molten metal 1 (which will be referred to as a parallel flow in this specification) (reference character A), the impingement flow depicted in FIG. 8, is a method for supplying the molten metal to the flow 31 of the coolant 4 which is injected upwards relative to the molten metal 1 falling from directly above (which is referred to as impingement flow in this specification) (reference character B). The pool system illustrated in FIG. 10, is a method for supplying the molten metal 1 to the pool 36 in which water is filled in a vertical pipe having an inside diameter of 155 mm (reference character C). The distance between the nozzle from which the molten metal 1 is dropped and the liquid surface of the coolant 4 is 30 mm in all the methods. Furthermore, the subcooling degree of the coolant 4 (initial subcooling degree in the method illustrated in FIG. 10) is determined as 85 K. Finally, the initial temperature of the molten metal (tin) 1 is determined as 700° C., and droplet diameter is determined as 3.2 mm.

Referring to FIG. 11, it was found that formation of fine particles of the molten metal 1 is maximally facilitated when the droplet of the molten metal 1 is brought into contact with the parallel flow (in case of reference character A) and the efficiency of formation of fine particles is high in the order of the method for dropping the droplet of the molten metal 1 into the pool 36 (in case of reference character C) and the method for bringing the droplet of the molten metal 1 into contact with the impingement flow (in case of reference character B). The efficiency of formation of fine particles is optimal in the method using the parallel flow because of the following reason. When supplying the molten metal 1 into the parallel flow, the molten metal 1 can be made to flow together with the flow 31 of the coolant 4 without significantly changing the direction thereof. Therefore, the shear stress received by the molten metal 1 from the flow 31 of the coolant 4 can be minimized. As a result, it can be considered that boiling due to spontaneous-bubble nucleation is most apt to be generated and stably grows and most of the droplets of the molten metal 1 can be related with vapor explosion. In addition, in case of the method of falling droplets of the molten metal 1 into the pool 36, it can be considered that the formation of fine particles of the molten metal 1 is not greatly facilitated since the substantial subcooling degree of the coolant 4 with which the following droplet comes into contact is lowered. On the other hand, as for the method for bringing the droplets of the molten metal 1 into contact with the impingement flow, it was observed that fine particles of the lower part of the droplet which can be a collision surface are formed due to vapor explosion but any other part quenches and is not formed into fine particles.

Figure 12:
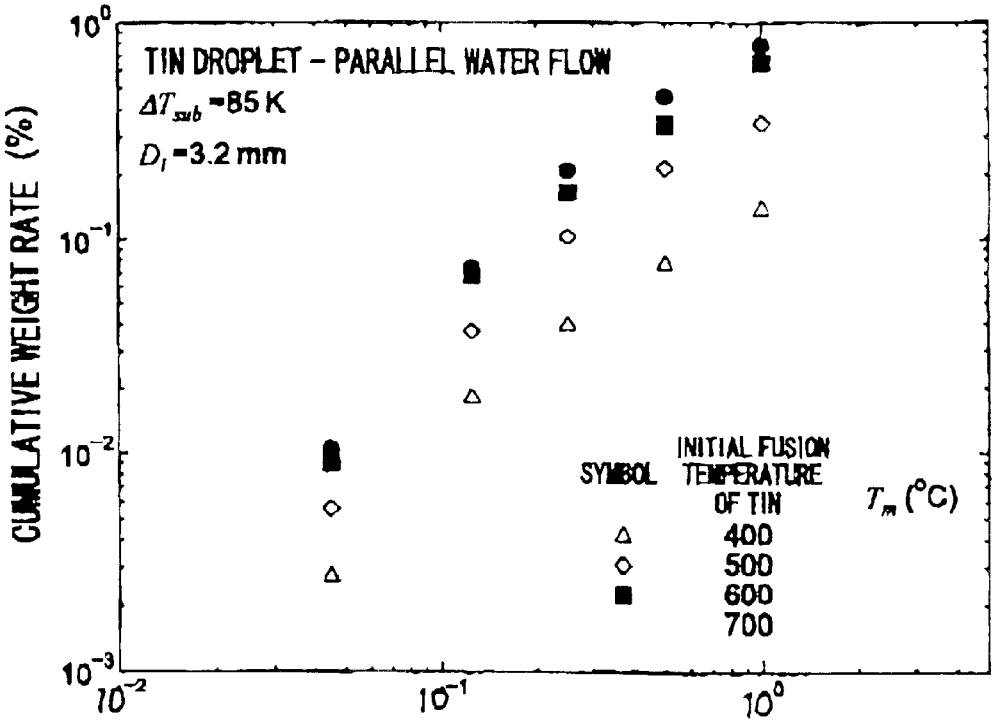
FIG. 12 is a graph showing particle size distribution of metal fine particles produced by changing the molten metal temperature.

FIG. 12 shows the particle size distribution obtained by bringing the coolant and the molten tin droplet into contact with each other by the parallel flow system having the maximal efficiency of formation of fine particles in accordance with each molten tin temperature. With increase in the initial molten tin temperature, the formation of fine particles is facilitated. It is considered that the formation of fine particles is facilitated because the pressure generated by vapor explosion becomes high when the enthalpy difference until the solidification point at the time of direct contact is large and the viscosity coefficient thereby becomes small. However, with an increase in temperature, the influence of these factors on the fragmentation into fine particles becomes small. Additionally, since vapor explosion does not occur because the vapor film does not spontaneously collapse when a given temperature or above is reached, it can be considered that an optimum temperature exists for the fragmentation into fine particles.

Based on these results, it became apparent that an optimum initial temperature for the fragmentation into fine particles exists and the fragmentation into fine particles is maximally facilitated when all of the droplets are related to vapor explosion in the contact mode in which the relative velocity with respect to the coolant is small.

When fragmenting the molten metal 1 into fine particles using the above production method and apparatus, even a material which is difficult to fragment into powder form via conventional methods can be readily fragmented. Therefore, new materials which have been considered difficult to fragment, for example, the materials described below, can be utilized.

(a) High Strengthening of a Gas Turbine Wing or a Jet Turbine Wing

When producing nickel-based alloy and yttrium oxide in powder form devised in the present invention and mixing them together to be uniform for mechanical alloying, a material having high strength can be obtained. This material is expected to be applied for a gas turbine wing or a jet turbine wing.

(b) Development of Ceramic Coating Material

When coating a gas turbine wing with ceramics by spraying, it is suitable to use cerium oxide, magnesia or calcium oxide as a coating material in terms of heat shield. However, it has been difficult to fragment such materials, such as cerium oxide, magnesium oxide and calcium oxide into powder form and to put them to practical use. In the present invention, ceramics such as cerium oxide, magnesium oxide and calcium oxide can be fragmented and a coating having a high heat-shield effect can be realized.

(c) Nanocrystal Material

When heating the obtained amorphous material to the vicinity of its fusion point, a material whose crystal grain diameter is small can be obtained as a high-strength material.

Incidentally, although the above-described mode is an example of the preferred case devised in the present invention, the invention is not restricted thereto, and various kinds of modifications can be carried out without deviating from the scope of the invention. For example, a description has been made in the above mode with respect to a case of metal fine particle production representatively. However, the materials which can be fragmented into fine particles by the present invention are not restricted to the molten metal 1, materials other than metals, for example, blast furnace slag or molten coal ash generated in a coal gasification furnace, molten ash of waste generated in an incinerator, ceramics or others can be fragmented into fine particles. That is, cooled fine particles may be recovered from the coolant 4 after a material other than a metal such as blast furnace slag, molten coal ash, molten waste ash or ceramics is melted and then fed into the liquid coolant 4 to cause boiling due to spontaneous-bubble nucleation and a pressure wave generated by the boiling fragments the material such as ceramics into fine particles while cooling the fine particles. For example, ceramics of slug or the like generated in the blast furnace and also cerium oxide, magnesium oxide, calcium oxide and the like which are suitable for use as a heat-shield material can be fragmented.

Generally, ceramics has a high fusion point (1200~3000° C.) and the viscosity of ceramics in the molten state is high. Thus, a nozzle for atomizing the molten ceramics deteriorates significantly when producing fine particles of ceramics by the atomizing method and also the molten ceramics easily clog the nozzle. The atomizing method, therefore, has not been suitable for producing fine particles of ceramics. On the contrary, the present invention is devoid of the drawbacks of the atomizing method, and the present invention is also suitable for fragmentation of a material whose fusion point is high or whose viscosity in the molten state is high such as ceramics. Incidentally, it is preferable to add salt to the coolant 4 to facilitate generation of boiling caused through spontaneous-bubble nucleation when converting a material whose fusion point is high into fine particles.

Furthermore, in the above description, an inert gas atmosphere is used in the casing 15 as the oxidation inhibiting means 14. However, instead of using an inert gas atmosphere, a reduced gas atmosphere such as that of hydrogen or carbon monoxide may be used, or the pressure in the casing 15 may be reduced to obtain the vacuum state with the low oxygen density. Incidentally, boiling due to spontaneous-bubble nucleation can be intensified by reducing the pressure in the casing 15, and formation of fine particles of the metal droplets 1 can be further facilitated. Furthermore, the entire apparatus may be set in the inert gas atmosphere or the reduced gas atmosphere, or it may be set in the casing in which the pressure is reduced.

Moreover, the external force may be previously applied to the molten material 1 to form fine particles, and then they may be supplied into the coolant 4. For example, by providing means for forming fine particles of the molten material 1 between the material supplying means 3 and the coolant 4, the grains of the molten material 1 can be ground to some extent and then supplied into the coolant 4. In this case, since the molten material 1 is ground to some extent by the fine particle forming means and then supplied into the coolant, the specific surface area is increased, and generation of the vapor film and cooling become more efficient. Thereafter, boiling due to spontaneous-bubble nucleation is generated in the coolant 4, and the pressure wave produced by this boiling can be utilized to further facilitate fragmentation into fine particles of the molten material 1. Also, the cooling rate can be further improved. As the fine particle fragmentation means for fragmentation into fine particles of the molten material 1, application of the ultrasonic irradiation technique which has been already established as the fragmentation technique is preferable, for example. As shown in FIG. 5, an ultrasonic irradiation apparatus 16 may be set between the material supplying means 3 and the coolant 4, and the ultrasonic wave of approximately 10 kHz to 10 MHz may be irradiated to the molten material 1 dropped from the material supplying means 3. Furthermore, an electric field can be formed in the space through which the molten material 1 passes, and an apparatus which forms fine particles of the molten material 1 can be used. Incidentally, it can be considered that the formation of fine particles of the molten material 1 is appropriately carried out immediately after discharging the molten material 1 from the material supplying means 3.

Furthermore, although the molten metal 1 as the molten material is supplied to the mixing nozzle 2 by dropping the molten metal 1 from the hot water outlet 7*a* of the crucible 7 in the above description, the molten metal 1 may be jetted from the hot water outlet 7*a*. In this case, the molten metal 1 must be jetted in a thread form and its quantity must be small.

Moreover, although description has been mainly given from the viewpoint of the vapor film collapse based on the spontaneous collapse caused through condensation, the vapor film may collapse due to an external factor in some cases. For example, the ultrasonic irradiation apparatus which irradiates the ultrasonic wave of approximately 10 kHz to 10 MHz to the mixing nozzle 2 constituting the cooling section or the flow of the coolant can be set, the vapor film which covers the circumference of the droplet of the molten material in the coolant can collapse in the early stage, and the droplets of the molten material and the coolant can be directly brought into contact with each other in the high-temperature state, thereby causing efficient boiling due to spontaneous-bubble nucleation. It is preferable to form fine particles from a metal having a high fusion point such as ceramics. In this case, since the vapor film collapses from any direction, it may not collapse in any other area, e.g., on the opposite side, or spontaneous-bubble nucleation may not be efficiently generated even if the vapor film collapses. Therefore, it is desirable to make arrangements so as to collapse the vapor film from multiple-directions in order to prevent a situation that fine particles of all of the molten metal cannot be formed such that a lump of the material remains.

What is claimed:

1. A method for producing fine particles which comprises: supplying a molten material into a liquid coolant, said molten material having a raw material to be fragmented into fine particles; forming a vapor film which covers said molten material in said coolant; collapsing said vapor film; directly bringing said molten material into contact with said coolant; causing boiling due to spontaneous-bubble nucleation; and forming fine particles of said molten material while tearing said molten material by utilizing a pressure wave generated by said boiling while cooling and solidifying the fine particles.

2. A method for producing fine particles according to claim 1, wherein said molten material remains molten at a temperature which causes an interface temperature with said coolant to become not less than a spontaneous-bubble nucleation temperature when directly brought into contact with the coolant and which is not more than a film boiling lower limit temperature and the molten material is supplied into said coolant, a stable vapor film which covers said molten material in said coolant is formed, and it is collapsed by condensation.

3. A method for producing fine particles according to claim 1, wherein said molten material is supplied into the said coolant by dropping the said molten material.

4. A method for producing fine particles according to claim 1, wherein the said molten material is supplied into the said coolant in an atomized form.

5. A method for producing fine particles according to claim 1, wherein salt is added into the said coolant.

6. A method for producing fine particles according to claim 1, wherein the said molten material and the said coolant are supplied in the same direction with a small difference in the flow rate, and mixed.

7. A method for producing fine particles according to claim 6, wherein the flow of said coolant has an area in which said coolant falls in the vertical direction, and supplying said molten material in said area of flow by free fall.

8. A method for producing fine particles according to claim 1, wherein an ultrasonic wave is irradiated to said molten material before said molten material is brought into contact with said coolant.

9. A method for producing fine particles according to claim 1, wherein said molten metal is supplied into said coolant while preventing oxidation thereof.

10. A method for producing fine particles according to claim 1, wherein a difference in the flow rate between said coolant and said molten material in said coolant is not more than 1 m/s.

11. A method for producing fine particles according to claim 1, wherein the vapor film which covers said molten material is collapsed by ultrasonic irradiation.

12. Apparatus for producing fine particles comprising: material supplying means for supplying a molten material while controlling the supply quantity thereof, said molten material having a raw material to be fragmented into fine particles; a cooling section bringing in a small quantity of coolant being sufficient for cooling and solidifying said molten material, means for mixing said coolant with a small quantity of said molten material being supplied from said material supplying means, forming a vapor film which covers said molten material, collapsing said vapor film, directly bringing said molten material into contact with said coolant, and causing boiling due to spontaneous-bubble nucleation, and solidifying said molten material and forming fine particles thereof while tearing said molten material by utilizing a pressure wave being generated by said boiling; and recovery means for recovering said fine particles from said coolant.

13. Apparatus for producing fine particles according to claim 12, wherein said material supplying means is configured to drop said molten material into said coolant.

14. Apparatus for producing fine particles according to claim 12, including means for adding salt into said coolant.

15. Apparatus for producing fine particles according to claim 12, wherein said cooling section is configured to form a flow of said coolant having an area in which said coolant falls into a free space in a vertical direction and to supply said molten material into said fall area of said flow of said coolant by free fall.

16. Apparatus for producing fine particles according to claim 12, wherein ultrasonic irradiating means for irradiating an ultrasonic wave to said molten material is provided between said material supplying means and said coolant in said cooling section.

17. Apparatus for producing fine particles according to claim 12, wherein oxidation inhibiting means is provided for inhibiting oxidation of molten metal supplied from said material supplying means to said cooling section.

18. Apparatus for producing fine particles according to claim 12, wherein a quantity of said coolant staying in said cooling section is such that large-scale vapor explosion can not be generated even if control in said material supplying means is lost and said molten material is supplied at a time.

19. Apparatus for producing fine particles according to claim 12, including means whereby the vapor film which covers said molten material is collapsed by ultrasonic irradiation.

* * * * *